United States Patent [19]

Horn

[11] 4,003,600

[45] Jan. 18, 1977

[54] UPHOLSTERED FURNITURE

[76] Inventor: Dieter Horn, Backnanger Str. 40, D-7062 Rudersberg, Germany

[22] Filed: Oct. 1, 1975

[21] Appl. No.: 618,342

[52] U.S. Cl. ..... 297/454; 297/DIG. 1; 297/DIG. 2

[51] Int. Cl.[2] ..... A47C 7/02

[58] Field of Search ..... 297/DIG. 1, DIG. 2, 297/452, 454–458

[56] References Cited

UNITED STATES PATENTS

| | | | |
|---|---|---|---|
| 2,649,146 | 8/1953 | Sanford et al. | 297/457 X |
| 2,818,107 | 12/1957 | Thaden | 297/DIG. 2 |

*Primary Examiner*—James C. Mitchell
*Attorney, Agent, or Firm*—Craig & Antonelli

[57] ABSTRACT

A furniture construction which includes a rigid rectangular frame formed of a plurality of spaced interconnected elements defining the sides of the frame. At least one spring member is provided which extends between and is connected to opposed sides of the frame. The frame and the at least one spring member is formed of one piece of a material which consists essentially of a rigid foamed plastic material.

23 Claims, 3 Drawing Figures

UPHOLSTERED FURNITURE

The present invention relates to a chair with upholstery, which is in a supporting relationship with a spring base, comprising a rigid frame, whose surface is spanned by at least one spring element, with both the rigid frame and the spring element(s) comprising a foamed plastic.

An upholstered chair is known (German Utility Patent No. 1,199,103), which, aside from several reinforcing inserts, is entirely of foamed plastic, with the supporting members, such as the frame and the core of the backrest, for example, being fabricated of a rigid foam. The space defined by the frame is spanned by a slab of a rigid foam. The upholstery comprises a soft foam applied in the appropriate locations. The backrest is screwed onto the frame. However this known furniture is relatively complicated to fabricate, as it must generally be assembled from individual components and/or because it must be fabricated in numerous foaming operations, each performed in a different mould.

It is the object of the present invention to improve upholstered furniture of the type described above in such a manner as to permit it to be fabricated much more economically and better comply with the requirements of use, in particular with respect to its springing characteristics.

According to the present invention, this object is solved in that frame an spring elements are fabricated as one piece, of the same material, in one step in a mould. The particular advantage of this furniture is that it can be fabricated very economically, since it is produced in one single step and in one mould. It is sufficient to simply place the upholstery, in particular loose cushions, thereon afterwards, which concludes the entire assembly operation. Both the frame and the spring elements are of rigid foam with an enclosed surface. It was found that the employment of a rigid foam instead of a semirigid foam is significantly more favourable not only for the frame, but also for the spring elements, as the spring characteristics of a rigid foam, in particular the deflection, are better. The reduced damping does not make any difference in the springs of furniture.

The spring elements, which are designed as a slab with holes in the known furniture, can be of highly varying design. In a preferred embodiment of the invention, strips formed to the frame are provided as spring elements. The employment of strips results in much more favourable springing characteristics than the employment of a slab. In addition, through the selection of an appropriate cross section of the strips, it is possible to achieve better springing characteristics with less material than would be possible with slab.

Of primary importance for achieving the desired springing characteristics is the nature of the transition between the spring elements and the frame. In a preferred embodiment of the invention, the cross section of at least two parallel braces of the square frame is of U-shaped design, with the inner leg of the U being shorter than the outer leg of the U and the strips being formed to the free end of the inner leg of the U. By designing the frame as a profile significant savings of material are possible without affecting the strength. By forming he strips to the free end of the inner leg of the U, this U leg is also employed for springing. Thus, the ends of the strips are not rigidly connected, but attached to spring supports. Since the free end of the inner leg, to which the strips are formed, can move in the direction of the plane of the seat surface, the strips can bend. In this connection, it is possible for the strips to be arched upwardly and to bend straight or arch downwardly when subjected to a force; they can also be arched downwardly in their normal state.

In order to be able to additionally influence the springing characteristics, in preferred embodiments of the invention the inner leg of the U has openings, whose width is approximately equal to the clearance between the strips and which extend generally to the yoke of the U. This embodiment provides the advantage that the openings in the inner legs of the U, which are adjacent to the strips, also serve as spring elements.

In order to achieve relatively resilient springing it is frequently necessary to permit the spring elements to have a relatively large degree of deformation. However the strains to which the spring elements are subjected can exceed that degree which is permissible for the material. For this reason, in preferred embodiments of the invention at least the spring elements have a reinforcement which absorbs the tensile forces. Employed as the reinforcement, for example, are fibres, in particular glass fibers. Processing is quite simple, as it is sufficient to put the reinforcement into the mould prior to foaming. It is merely necessary to ensure that the reinforcement assumes its desired position during the foaming operation. The employment of a reinforcement provides the advantage that the quantity of rigid plastic foam required can be even further reduced, while the springing characteristics and the load capacity can be improved.

Instead of a fibreglass reinforcement, a metallic insert can also be employed as the reinforcement. It is preferable for a spring rod to be provided as the metallic insert, with the spring rod being surrounded by plastic foam during the foaming operation. As opposed to helical springs which are foamed into place, a spring rod does not destroy the adjacent foam material, as it only performs bending movements, which the foam material can follow, while a helical spring performs both bending and torsion movements, which causes the adjacent foam material to tear.

In many cases, the frame with the spring elements is inserted into a furniture body. In this case, the frame merely serves as a support for the spring elements. In preferred embodiments of the invention, on the other hand, the frame and the furniture body are one piece. This permits the frame to simultaneously serve as a body of the furniture.

The above discussed an other objects, features and advantages of the present invention will become more apparent from the following description thereof, when taken in conjunction with the accompanying drawings of a practical example, in which FIG. 1 shows a top view of the design of the body, frame and springs of a chair, without upholstery, according to the present invention;

Figure 1:
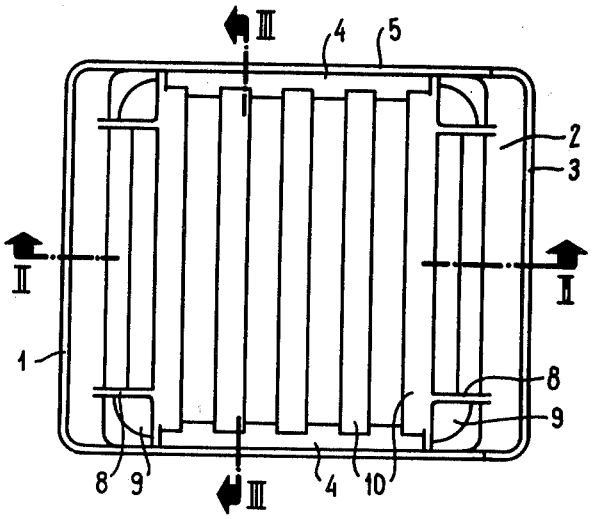

Referring now to the drawings, wherein like reference numerals designate like parts throughout the several views, the body and frame of the illustrated chair are fabricated in one piece. The outer section of the frame, which forms the furniture body, comprises a front section 1 and a back section 2 which is parallel thereto and to which a backrest 3 is formed. Front section 1 and back section 2 are connected one with the other by means of two parallel side members 4. The cross section of side members 4 is of U-shaped design, having a longer, outer leg 5, a yoke 6 in the area of the base, and a shorter, inner leg 7. Formed in the corners, in which front section 1 and rear section 2 are adjacent to side members 4, are angle webs 8, which, together with the adjacent portions of the front and rear sections and the side members, define a space or opening 9 for receiving an unillustrated leg of the furniture.

Inner leg 7 of side member 4 is shorter than outer leg 5. Formed to the free, upper end of inner leg 7 as a spring element is a strip 10 of flat rectangular cross section, to whose bottom a reinforcing rib 11 is centrally formed. Reinforcing rib 11 extends the entire length of strip 10, which spans from side member 4 to side member 4, whereby strip 10 can also be arched upwardly. In the area of the ends of strip 10, reinforcing ribe 11 becomes a support rib 12, which is tapered downwardly and formed to inner leg 7.

Figure 2:
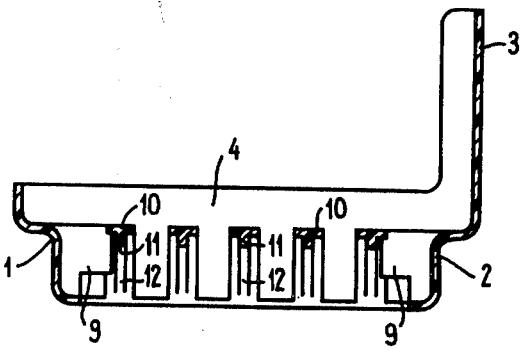
FIG. 2 shows a section taken along line II—II in FIG. 1.
Figure 3:
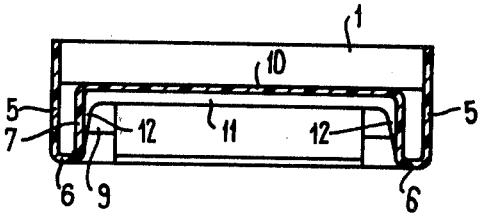
FIG. 3 shows a section taken along line III—III in FIG. 1.

As shown in FIG. 2, the inner leg 7 has openings along side member 4. The width of these openings is equal to the width of the strips 10, the remaining portions of inner leg leg 7 form with the support rib 12 a type of extension of strip 10 as can be seen in FIG. 3.

The illustrated portion is fabricated in one single foaming step in an appropriate mould. In particular, polyurethane foam is employed as the material. Reinforcements, such as glass fibres for example, can be foamed into strips 10, in particular into reinforcing ribs 11. In the same manner, a flat spring bar can also be foamed into each strip 10.

Through the selection of the cross section and the design of the cross section of strips 10, the springing characteristics can be selected within wide limits. The spring characteristics of those areas of inner legs 7 which are adjacent to strips 10 also influence the amount of permissible bend.

It is obvious that the invention is not limited to the illustrated practical example, but that variations therefrom are possible without leaving the scope of the invention. In particular, it is possible to employ individual characteritics of the invention either individually or in combination.

For example, it can be advantageous for certain portions of the furniture to have a soft foam layer or covering. In a preferred embodiment of the invention, at least the spring elements have a soft foam layer or covering, in particular one which is sprayed on. Since the spring elements are of rigid foam, the soft foam layer adheres securely and neither separates nor is destroyed when the spring elements bend. This effect is achieved primarily if the spring elements are only subjected to bending strains, such as strips, for example. In known upholstered furniture, in which helical springs are sprayed with soft foam, the soft foam separated and was destroyed in the area of the springs, as the springs were subjected to both bending and torsion strains.

Having thus fully disclosed our invention, what I claim is:

1. A chair or couch with upholstery, which is in a supporting relationship with a spring base, comprising a rigid frame, whose surface is spanned by at least one spring element, with both the rigid frame and the spring element(s) comprising a foamed plastic, in which frame and spring elements are fabricated as one piece, of the same material, in one step in a mould.

2. The furniture according to claim 1, in which strips formed to the frame are provided as spring elements.

3. The furniture according to claim 2, in which the cross section of at least two parallel braces of the square frame is of U-shaped design, with the inner leg of the U being shorter than the outer leg of the U and the strips being formed to the free end of the inner leg of the U.

4. The furniture according to claim 3, in which the inner leg of the U has openings, whose width is approximately equal to the clearance between the strips and which extend generally to the yoke of the U.

5. The furniture according to claim 1, in which at least the spring elements have a reinforcement which absorbs the tensile forces.

6. The furniture according to claim 5, in which fibres are employed as the reinforcement.

7. The furniture according to claim 5, in which a metallic insert is employed as the reinforcement.

8. The furniture according to claim 7, in which a spring bar is employed as the metallic insert.

9. The furniture according to claim 1, in which the frame and the body of the furniture are one piece.

10. The furniture according to claim 9, in which the frame simultaneously serves as the body of the furniture.

11. The furniture according to claim 1, in which at least the spring elements have a soft foam coating or are surrounded by soft foam, which is in particular sprayed on.

12. The furniture according to claim 6, in which said fibres consist of glass fibres.

13. A furniture construction comprising: a rigid rectangular frame formed of a plurality of spaced interconnected elements defining the sides of the frame, at least one spring member extending between and connected to opposed sides of the frame, said rigid frame and said at least one spring members being formed of one piece of a material consisting essentially of a rigid foamed plastic material.

14. A construction according to claim 13, wherein at least two opposed sides of the frame have a substantially U-shaped cross-sectional configuration defined by an inner leg and an outer leg connected by a yoke portion, said inner leg having a length which is shorter than the length of the outer leg and having a free end spaced from said yoke portion, and wherein said at least one spring member is formed at and extends between the free ends of the inner legs of the respective sides of the frame.

15. A construction according to claim 14, wherein said at least one spring member includes means for absorbing tensile forces.

16. A construction according to claim 15, wherein said absorbing means includes a plurality of fibers arranged in said at least one spring member.

17. A construction according to claim 15, wherein said absorbing means includes a metallic insert.

18. A construction according to claim 17, wherein said metallic insert is constituted by a spring bar.

19. A construction according to claim 13, wherein said absorbing means includes a metallic insert.

20. A construction according to claim 19, wherein said at least one spring member includes means for absorbing tensile forces.

21. A construction according to claim 19, wherein said absorbing means includes a plurality of fibers arranged in said at least one spring member.

22. A construction according to claim 21, wherein said absorbing means includes a metallic insert.

23. A construction according to claim 22, further comprising a furniture body, and wherein said frame and said furniture body are formed in one piece.

* * * * *